US006422430B1

(12) United States Patent
Ito

(10) Patent No.: US 6,422,430 B1
(45) Date of Patent: Jul. 23, 2002

(54) PRESSURE PUMP FOR HIGH VISCOSITY FLUID

(75) Inventor: Kikuo Ito, Tokyo (JP)

(73) Assignee: Yamada Corporation, Tokyo (JP)

( * ) Notice: Subject to any disclaimer, the term of this patent is extended or adjusted under 35 U.S.C. 154(b) by 0 days.

(21) Appl. No.: 09/697,504

(22) Filed: Oct. 27, 2000

(30) Foreign Application Priority Data

Feb. 2, 2000 (JP) ..... 12-025532

(51) Int. Cl.[7] ..... F04B 43/073
(52) U.S. Cl. ..... 222/386; 222/389
(58) Field of Search ..... 222/105, 146.5, 222/386, 389, 405, 256

(56) References Cited

U.S. PATENT DOCUMENTS

| | | | | |
|---|---|---|---|---|
| 2,630,248 A | * | 3/1953 | Hinz | 222/389 X |
| 4,661,688 A | * | 4/1987 | Gabryszewski | 222/259 X |
| 4,792,063 A | * | 12/1988 | Moore | 222/389 X |
| 5,137,368 A | * | 8/1992 | Kistner | 366/272 |
| 5,746,112 A | * | 5/1998 | Watson | 222/389 X |

FOREIGN PATENT DOCUMENTS

| | | | |
|---|---|---|---|
| EP | 1 122 434 A2 | * | 8/2001 |
| JP | 58-23985 | | 5/1983 |
| JP | 2001-0214854 | * | 8/2001 |

* cited by examiner

*Primary Examiner*—Kenneth Bomberg
(74) *Attorney, Agent, or Firm*—Wenderoth, Lind & Ponack, L.L.P.

(57) ABSTRACT

A pressure pump delivers a high viscosity fluid (32B) such as grease from a storage can or drum (32A) sealed by a follower plate unit (5) attached to a hollow transfer tube (4). The unit (5) can be air operated to reciprocate up and down relative to the storage can. The unit (5) has a body (6) fitting into the can with fluid guide passage (7) fitted inside a reciprocating cylinder (11) attached by a ring plate (12). An upper plate (17) is attached to the cylinder (11) and a lower plate (16) is attached to body (6) with a ring sealing member (18) interposed between the plates (16,17). An annular pressure chamber (27) between body (6) and cylinder (11) has a compressed air inlet/outlet port (28) to provide the required reciprocating movement. The seal member (18) can act as a bellows to maintain a seal as the cylinder reciprocates vertically.

3 Claims, 11 Drawing Sheets

(A)

(B)

(A)

(B)

(A)

(B)

PRESSURE PUMP FOR HIGH VISCOSITY FLUID

BACKGROUND OF THE INVENTION

The present invention relates to a pressure pump for drawing and delivering by pressure a high viscosity fluid such as adhesive, silicon, grease, printing ink or the like from a can such as drum can, a pail can or the like.

Heretofore, there has been known a pressure pump for high viscosity fluid in which, in order to draw and deliver by pressure a high viscosity fluid stored in a drum can or a pail can therefrom, a follow plate unit for sealing an upper surface of the drum can or the pail can so as to apply pressure to the high viscosity fluid stored therein is attached to a lower end of a transport pipe capable of being moved up-and-down with respect to the drum can or the pail can.

This conventional pressure pump for high viscosity fluid is configured such that, when the high viscosity fluid is to be drawn out of the drum can or the pail can, the follow plate unit is moved downward to seal a fluid surface of the high viscosity fluid and to apply pressure thereto, and at the same time an air pump is actuated to draw the high viscosity fluid from the can, and when the high viscosity fluid is completely drawn out of the drum can or the pail can, the follow plate unit is moved upward to be retracted therefrom (see, for example, Japanese Patent Laid-open Publication No. 82282 of 1996, Japanese Patent Registration No. 2545679).

This type of pressure pump for high viscosity fluid has problems that, if an outer end face of the follow plate unit is not brought into tight-contact with a wall inner surface of the drum can or the pail can, the high viscosity fluid is leaked out upward from a clearance between the outer end face of the follow plate unit and the wall inner surface when the follow plate unit is moved downward to apply pressure to the high viscosity fluid and accordingly the high viscosity fluid cannot be drawn therefrom efficiently, and that, if the outer end face of the follow plate unit is brought into excessive tight-contact with the wall inner surface of the drum can or the pail can, a contact resistance therebetween increases too much when the follow plate unit is to be disengaged from the drum can or the pail can and thereby the follow plate unit is lifted up together with the drum can or the pail can when the follow plate unit is retracted therefrom because of too large contact resistance therebetween. Conventionally, the follow plate unit for the drum can is configured such that an outer diameter of the follow plate unit extend when it is moved downward and is contracted when moved upward.

However, since the conventional follow plate unit for the drum can is configured so as for the outer diameter thereof to be contracted by own weight, there occurs a problem that the outer diameter of the follow plate unit cannot be contracted promptly when the follow plate unit having reached down to a bottom of the drum can is moved upward to be retracted from the drum can and as a result, the follow plate unit is lifted up together with the drum can because of the large contact resistance therebetween.

In order to solve the above problems, there has been developed an improved pressure pump for high viscosity fluid which allows the follow plate unit to be smoothly retracted from the drum can without deteriorating a sealing capacity for drawing the high viscosity fluid out of the drum can (see Japanese Patent Application No. 118469 of 1999, filing date: Apr. 26 of 1999).

The Japanese Patent Application No. 118469 of 1999 discloses the pressure pump for high viscosity fluid, in which a follow plate unit is composed of a lower plate attached to a transport pipe and an upper plate mounted on said lower plate so as to be capable of being moved up-and-down with respect thereto, wherein said lower plate is provided with a pressure disc for being brought into contact with the high viscosity fluid to apply pressure thereto, and said upper plate is provided with an annular elastic sealing member whose outer periphery is provided with a sealing contact portion which is engaged with an outer periphery of the pressure disc and whose outer end face is brought into contact with a wall inner surface of a drum can to make a sealing, and said lower plate is further provided with a plurality of air cylinders as an up-and-down driving member for moving up or down the upper plate, which moves the upper plate downward so that an outer diameter of the annular elastic sealing member may be extended when the high viscosity fluid stored in the drum can is to be drawn and delivered by pressure from the drum can and moves the upper plate upward so that the outer diameter of the annular elastic sealing member may be contracted when the follow plate unit is to be retracted from the drum can.

However, since the pressure pump for high viscosity fluid disclosed by the Japanese Patent Application No. 118469 of 1999 is configured such that each of the plurality of air cylinders is attached to the lower plate, the structure thereof is rather complicated and an assembling operation thereof is also rather troublesome.

SUMMARY OF THE INVENTION

The present invention is achieved in the light of the situation described above, and an object thereof is to provide an innovative pressure pump for high viscosity fluid which allows the follow plate unit to be smoothly retracted from the drum can without deteriorating a sealing capacity for drawing the high viscosity fluid out of the drum can and also allows an assembling operation thereof to be performed easily.

The invention defined by claim 1 provides a pressure pump for high viscosity fluid in which, in order to draw and deliver by pressure a high viscosity fluid stored in a can therefrom, a follow plate unit for sealing an upper surface of said can to apply pressure to said high viscosity fluid stored therein is attached to a lower end of a transport pipe capable of being moved up-and-down with respect to said can, said pressure pump characterized in that said follow plate unit comprises a follow plate body having a guide passage for high viscosity fluid, a cylinder fitted on an outer surface of said follow plate body so as to be capable of being moved upward and downward along a vertical direction, an upper plate attached to said cylinder so as to be capable of being moved upward and downward along therewith, a lower plate attached to a lower portion of said follow plate body, and a ring type elastic sealing member interposed between said upper plate and said lower plate, wherein a pressure chamber for making a compressed air flow in-and-out is provided between said follow plate body and said cylinder, a compressed air inlet/outlet port is provided on said cylinder so as to communicate with said pressure chamber, said ring type elastic sealing member comprises an upper ring type elastic sealing member and a lower ring type elastic sealing member, said lower ring type elastic sealing member is fixed to said lower plate, said upper ring type elastic sealing member is fixed to said upper plate, said upper ring type elastic sealing member and said lower ring type elastic sealing member are bonded with each other at outer peripheral portions thereof to be formed into a contact portion which is to be brought into contact with a wall inner surface of said can, and an outer diameter of said ring type elastic sealing member is extended or contracted by flow-in or flow-out of the compressed air to or from said pressure chambers.

The invention defined by claim 2 provides a pressure pump for high viscosity fluid in accordance with that defined by claim 1, said pressure pump further characterized in that a liner cylinder for guiding said cylinder along a vertical direction is inserted between said follow plate body and said cylinder, and an annular flange for partitioning said pressure chamber into an upper pressure chamber and a lower pressure chamber is formed on an outer surface of said liner cylinder.

The invention defined by claim 3 provides a pressure pump for high viscosity fluid in accordance with that defined by claim 2, said pressure pump further characterized in that said cylinder has a bottom cylinder sealing ring and a top cylinder sealing ring, an annular groove for receiving O-ring is formed on an inner surface of each of said bottom and said top cylinder sealing rings, an O-ring is fitted into each of said annular grooves for receiving O-ring in order to seal said compressed air within said pressure chamber, and another annular groove for receiving O-ring is formed on said annular flange, into which an O-ring is fitted for preventing a leakage of said compressed air from said upper pressure chamber to said lower pressure chamber.

DETAILED DESCRIPTION OF THE INVENTION

Embodiments of a pressure pump for high viscosity fluid according to the present invention will be described in detail with reference to the drawings attached herewith.

Figure 1:
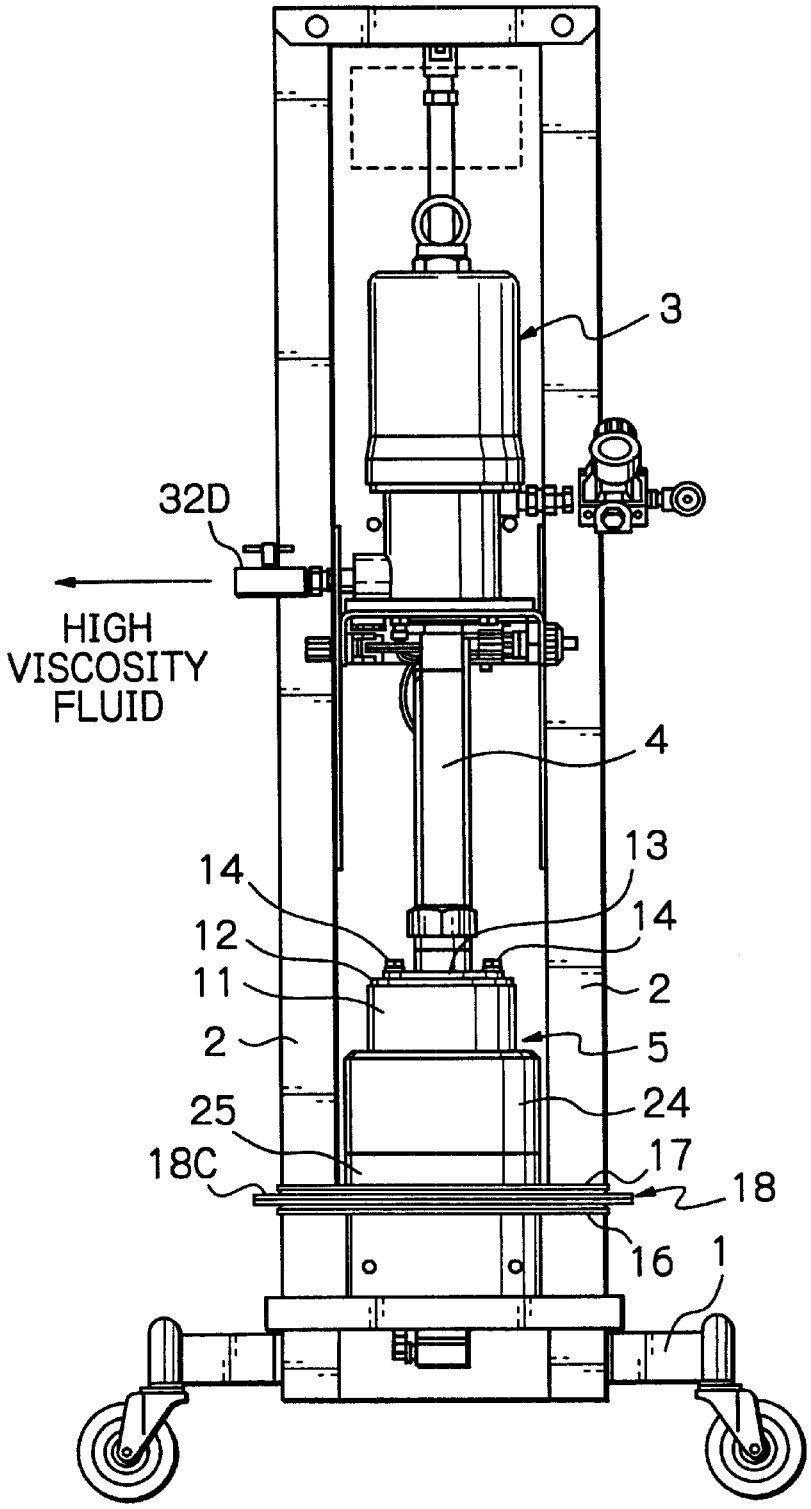
FIG. 1 is an elevational view of a pressure pump for high viscosity fluid according to the present invention.
Figure 2:
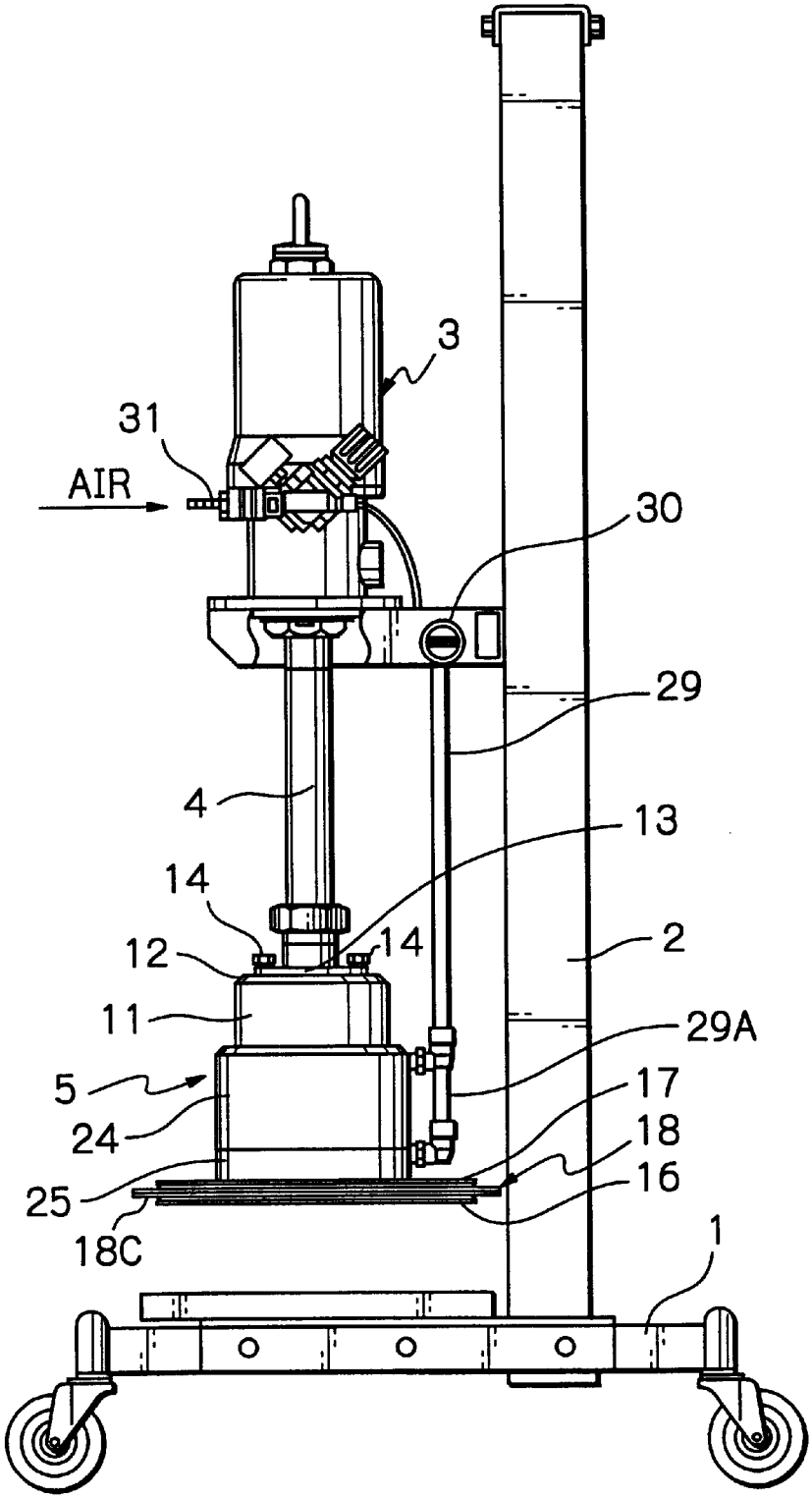
FIG. 2 is a side elevational view of a pressure pump for high viscosity fluid according to the present invention.

FIG. 1 is an elevational view of a pressure pump for high viscosity fluid and FIG. 2 is a side elevational view of the pressure pump shown in FIG. 1, wherein reference numeral 1 designates a base section provided with casters and reference numeral 2 designates a column. A can such as drum can, pail can or the like is mounted on the base 1. The column 2 is fixed to the base 1 at a bottom thereof and a lift 3 is attached to the column 2. The lift 3 is controlled by a controller though not shown.

The lift 3 has a transport pipe 4 for transporting the high viscosity fluid, and the transport pipe 4 is moved up-and-down along a vertical direction by the lift 3. A follow plate unit 5 is attached to a lower end of the transport pipe 4.

Figure 3:
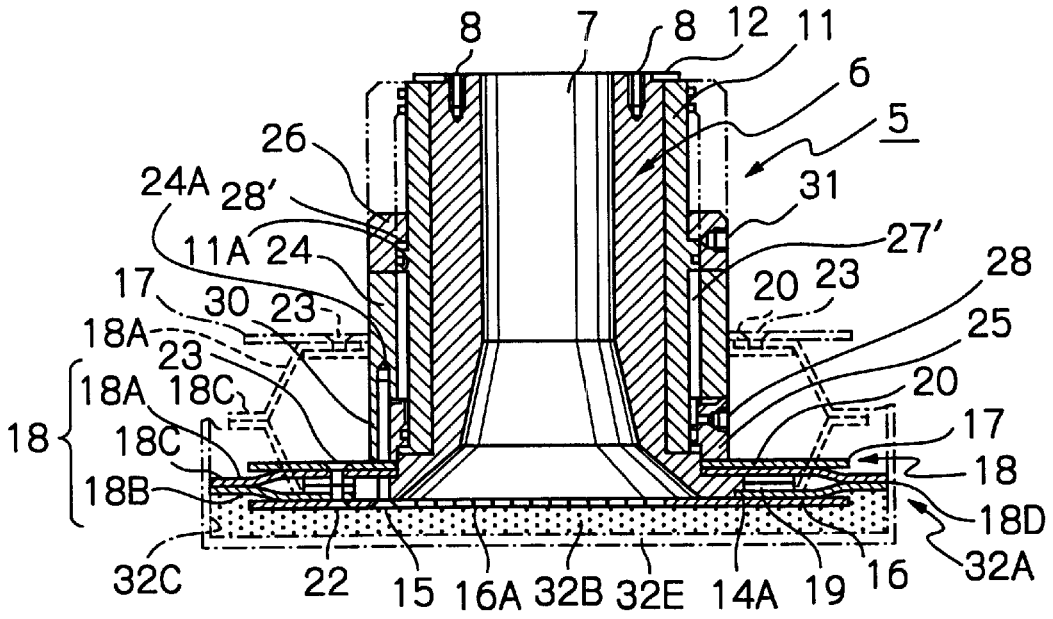
FIG. 3 is a cross sectional view of a follow plate unit taken on line A—A of FIG. 4.
Figure 4:
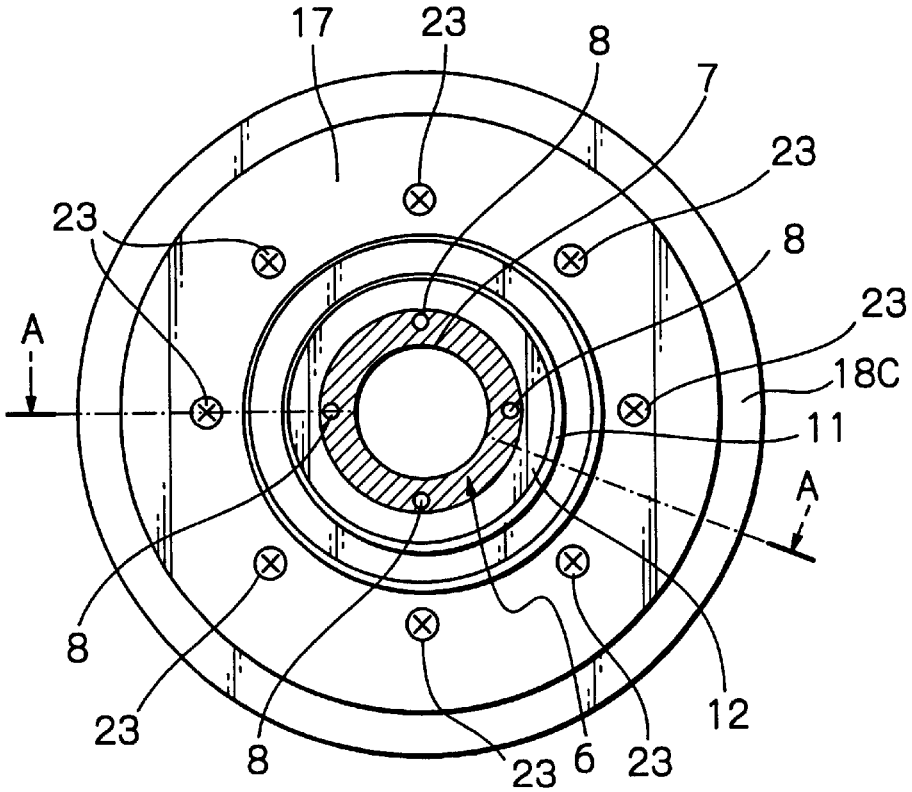
FIG. 4 is a plan view of the follow plate unit shown in FIG. 3.
Figure 5:
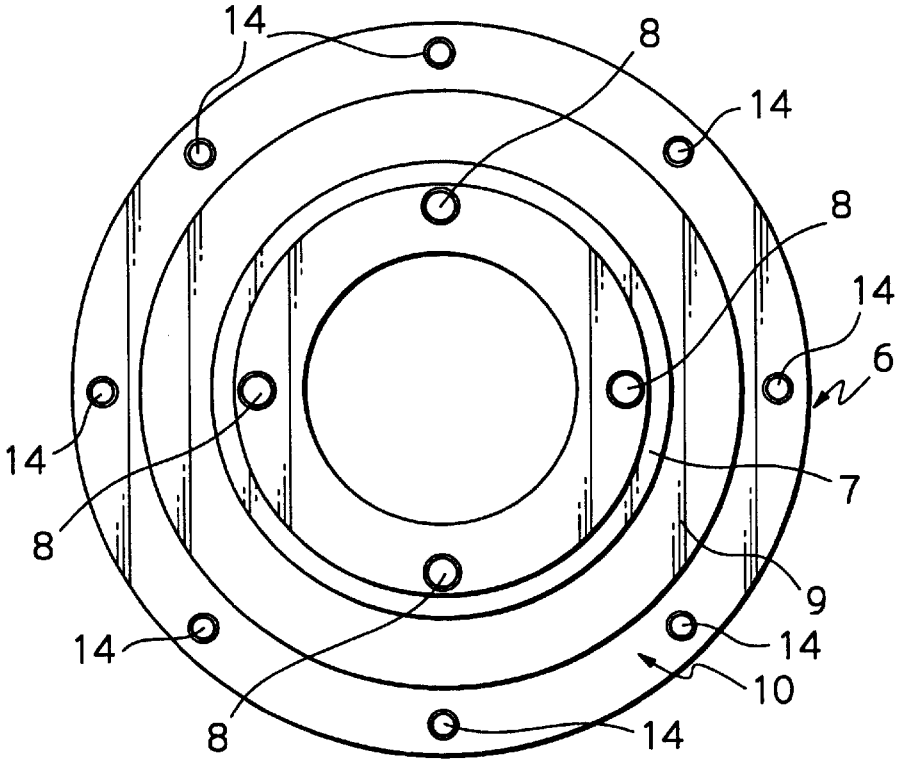
FIG. 5 is an enlarged plan view of a follow plate body shown in FIG. 3.
Figure 6:
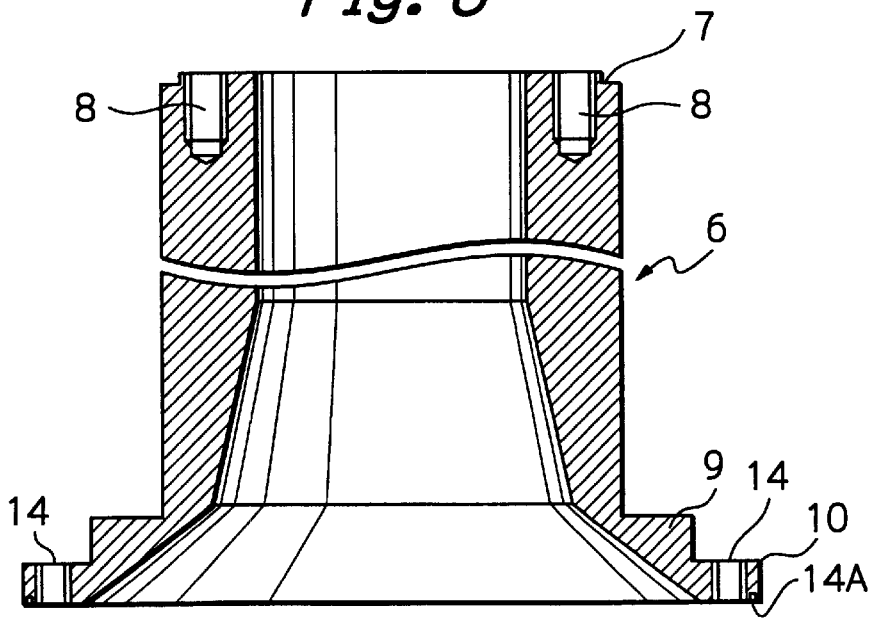
FIG. 6 is a longitudinal sectional view of the follow plate body shown in FIG. 5.

As shown in FIGS. 3, 4, the follow plate unit 5 has a cylindrical follow plate body 6. The follow plate body 6 has a vertical center through hole, which is a guide passage 7 for the high viscosity fluid. On a top surface of the follow plate body 6, as shown in enlarged drawings of FIGS. 5, 6, there are provided an annular step 7 and a plurality of threaded holes 8 along a pitch circle placing a specified distance therebetween. A lower portion of the follow plate body 6 is formed into two steps of annular steps 9 and 10.

Figure 7:
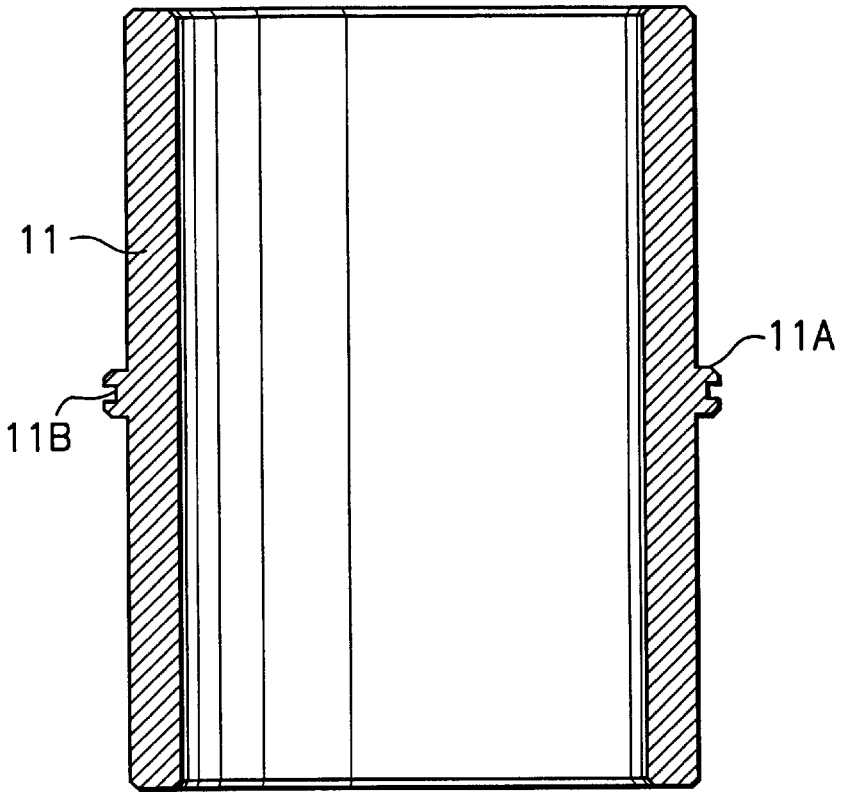
FIG. 7 is an enlarged longitudinal sectional view of a liner cylinder shown in FIG. 3.
Figure 8:
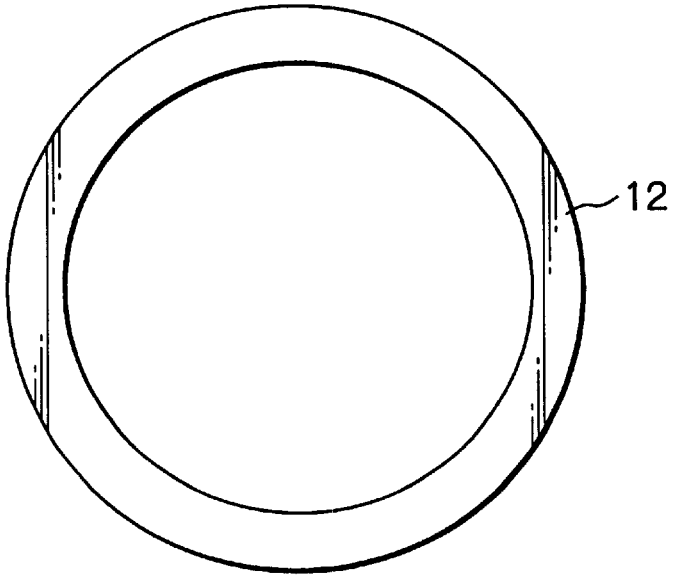
FIG. 8 is an enlarged plan view of a ring plate shown in FIG. 3.

The follow plate body 6 is inserted into a cylinder liner 11 which is shown in an enlarged drawing of FIG. 7. A ring plate 12 shown in an enlarged drawing of FIG. 8 is placed on the annular step 7 of the follow plate body 6. The annular step 9 of the follow plate body 6 serves as a bearing surface on which a lower end of the liner cylinder 11 abuts.

As shown in FIGS. 1, 2, a fixing flange 13 is attached to a lower end of the transport pipe 4, and the follow plate body 6 is fixed to the fixing flange 13 by a connecting bolt 14. When the follow plate body 6 is connected to the fixing flange 13, the liner cylinder 11 is vertically clamped by and fixed between the ring plate 12 and the annular step 9.

The liner cylinder 11 has an annular flange 11A formed on an outer surface thereof in a middle portion with respect to a vertical direction. The annular flange 11A has an annular groove 11B formed thereon for receiving O-ring. The annular flange 11A cooperates with a cylinder described later to form a pressure chamber on each of an upper and a lower sides of the annular flange 11A respectively.

Figure 9:
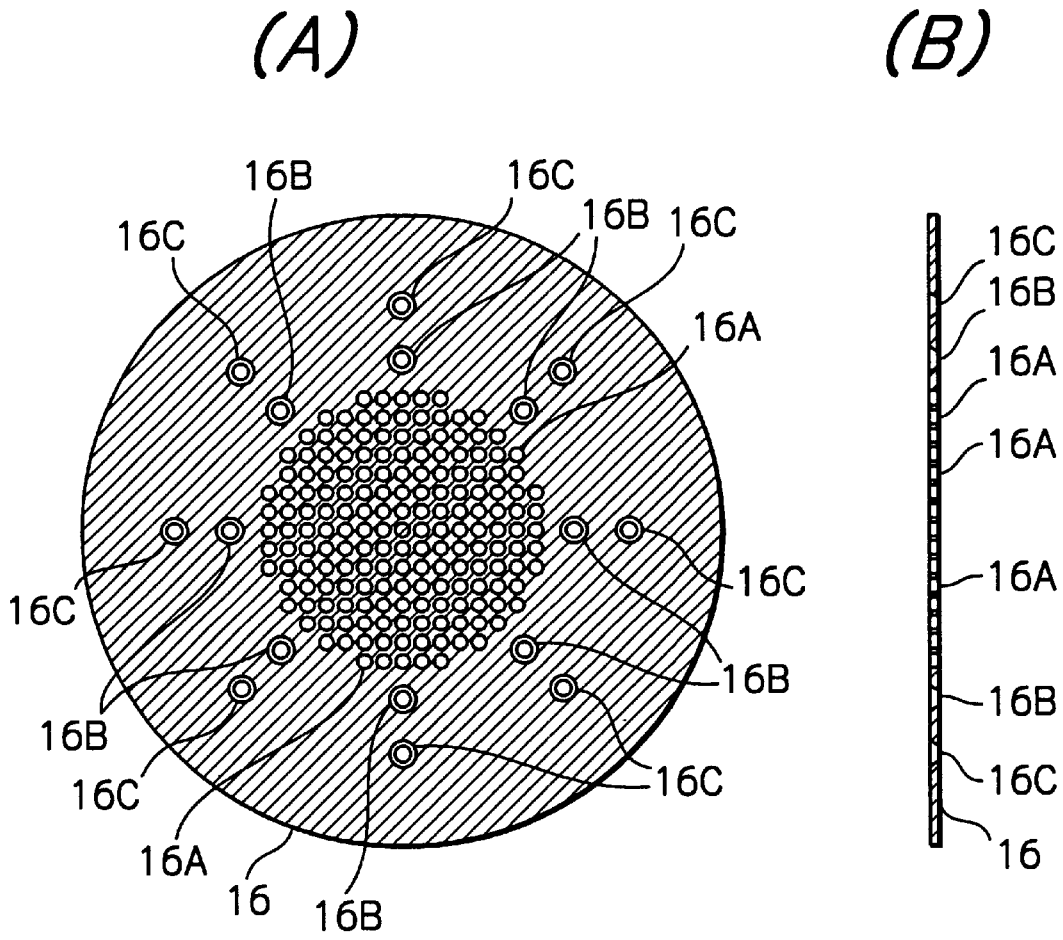
FIG. 9 is an enlarged view of a lower plate shown in FIG. 3, wherein (A) is a plan view and (B) is a longitudinal sectional view.

A plurality of threaded holes 14 is formed on the annular step 10 of the follow plate body 6 along a pitch circle placing a specified distance between holes. On an under surface of the annular step 10, there is provided an annular groove 14A for receiving O-ring, and a pressure disc or a circular lower plate 16 shown in enlarged drawings of FIGS. 9(A), 9(B) is attached to the under surface of the annular step 10 by a connecting screw 15. The lower plate 16 has a plurality of small holes 16A in a central portion thereof for filtering the high viscosity fluid and also a plurality of through holes 16B, 16C for screw each disposed outer side of the small holes along respective pitch circles placing respective specified distances between holes respectively, wherein an arrangement of the holes 16B corresponds to that of the threaded holes 14 so that the connecting screw 15 may be applied through them.

Figure 10:
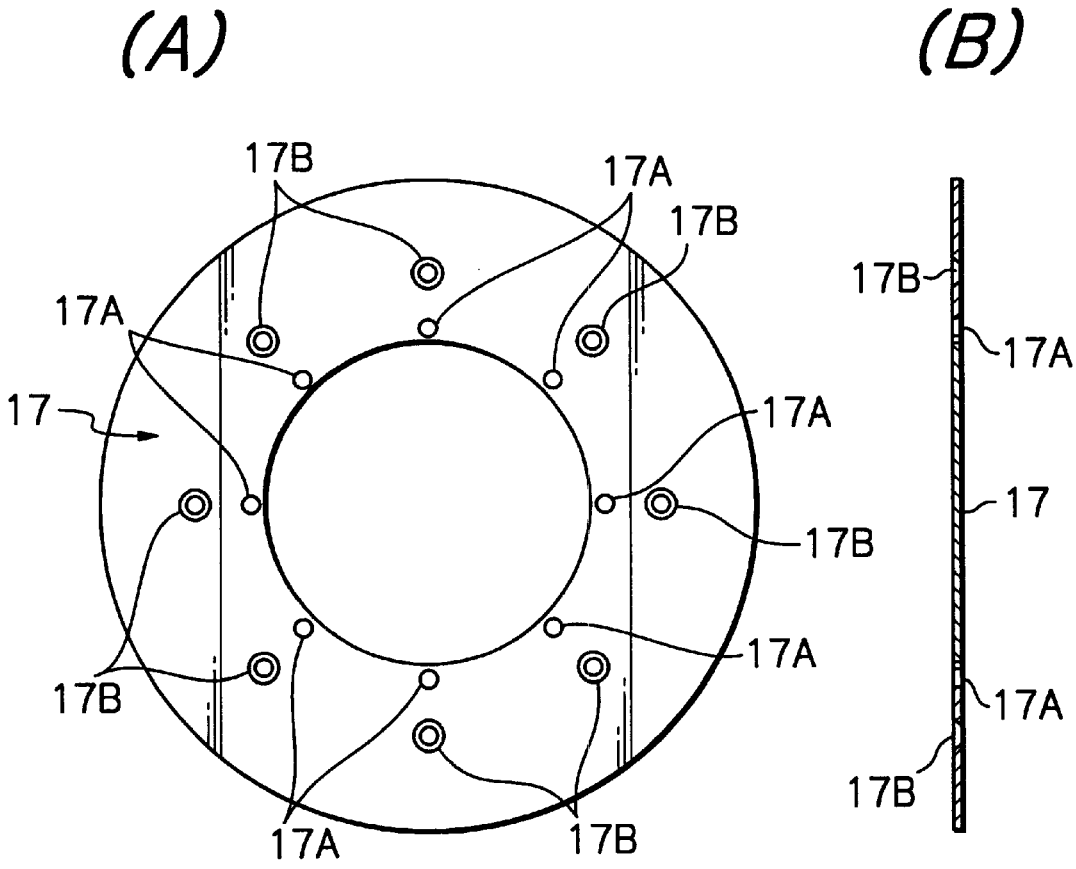
FIG. 10 is an enlarged view of an upper plate shown in FIG. 3, wherein (A) is a plan view and (B) is a longitudinal sectional view.

A ring type upper plate 17 shown in enlarged drawings of FIGS. 10(A), 10(B) is disposed on an upper surface of the annular step 10. The upper plate 17 is provided with a plurality of holes 17A, 17B for screw each disposed along respective pitch circles placing respective specified distances between holes respectively.

Figure 11:
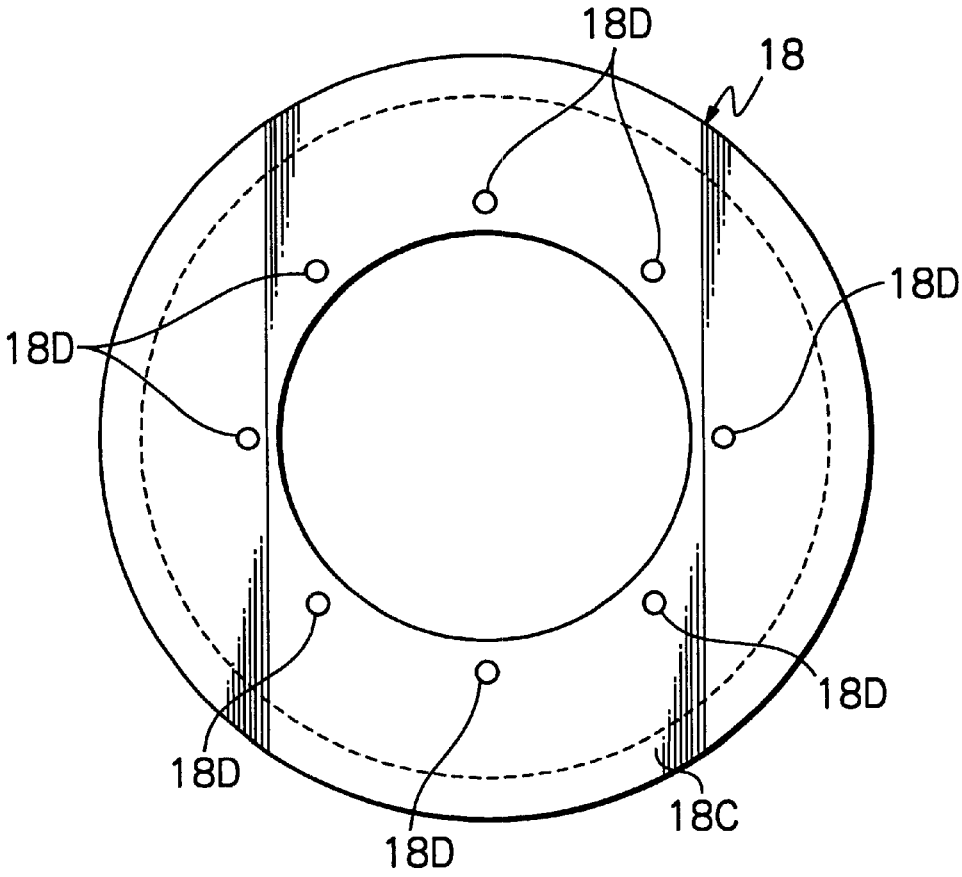
FIG. 11 is an enlarged view of a ring type elastic sealing member shown in FIG. 3, wherein (A) is a plan view and (B) is a longitudinal sectional view.
Figure 11:
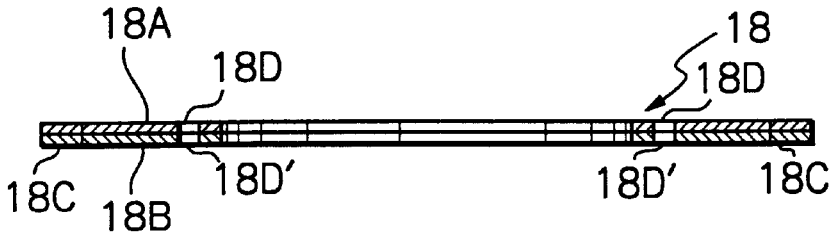

An ring type elastic sealing member 18 is disposed between the upper plate 17 and the lower plate 16. As shown in enlarged drawings of FIGS. 11(A), 11(B), the ring type elastic sealing member 18 is composed of an upper ring type elastic sealing member 18A and a lower ring type elastic sealing member 18B. The upper ring type elastic sealing member 18A and the lower ring type elastic sealing member 18B are bonded with each other at outer peripheries thereof to form the outer peripheries into a contact portion 18C for being brought into contact with a wall inner surface of the can. Each of the elastic sealing members 18A, 18B is provided with a plurality of through holes 18D, 18D' for screw formed near to an inner boundary thereof along a pitch circle placing a specified distance between holes.

Figure 12:
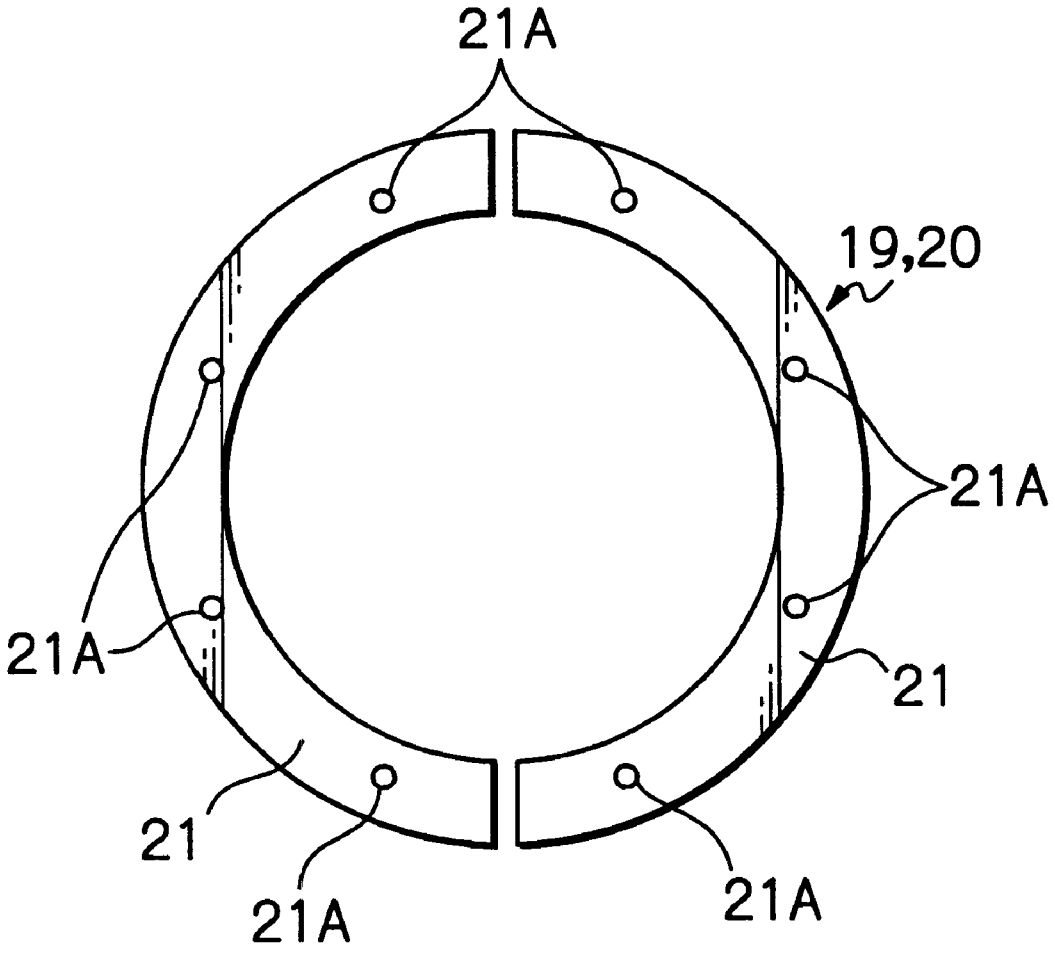
FIG. 12 is an enlarged plan view of a support plate shown in FIG. 3.

The through holes 18D for screw are disposed so as for a position thereof to correspond to that of the through holes 17B for screw of the upper plate 17. The through holes for screw 18D' are disposed so as for a position thereof to correspond to that of the through holes 16C for screw of the lower plate 16. Two sheets of support plates 19, 20 are inserted between the upper ring type elastic sealing member 18A and the lower ring type elastic sealing member 18B. As shown in an enlarged drawing of FIG. 12, each of the support plates 19, 20 is composed of a pair of semicircular ring plates 21. A plurality of threaded holes 21A is formed on the semicircular ring plate 21 along a pitch circle placing a specified distance between holes. The lower ring type elastic sealing member 18B is fixed to the lower plate 16 by a connecting screw 22. The upper ring type elastic sealing member 18A is fixed to the upper plate 17 by a connecting screw 23.

A bottom cylinder sealing ring 25, which is a component of a cylinder 24, is fitted on a lower portion of the liner cylinder 11 before the liner cylinder 11 is fitted on the follow plate body 6. The cylinder 24 is fitted on an upper portion of the liner cylinder 11 from an upper side thereof. A lower pressure chamber 27' is defined by the annular flange 11A of the liner cylinder 11, a lower portion of the cylinder 24 and the bottom cylinder sealing ring 25, while an upper pressure chamber 28' is defined by the annular flange 11A of the liner cylinder 11, an upper portion of the cylinder 24 and a top cylinder sealing ring 26 formed integrally with the cylinder 24.

Figure 13:
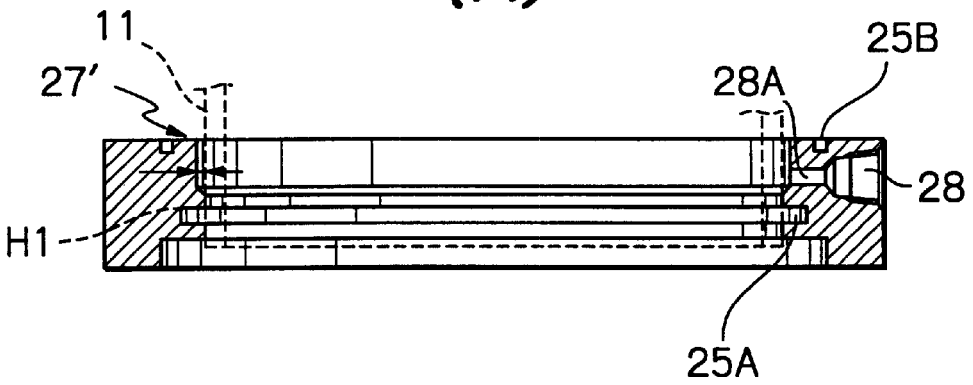
FIG. 13 is an enlarged view of a bottom cylinder sealing ring shown in FIG. 3, wherein (A) is a longitudinal sectional view and (B) is a plan view.
Figure 13:
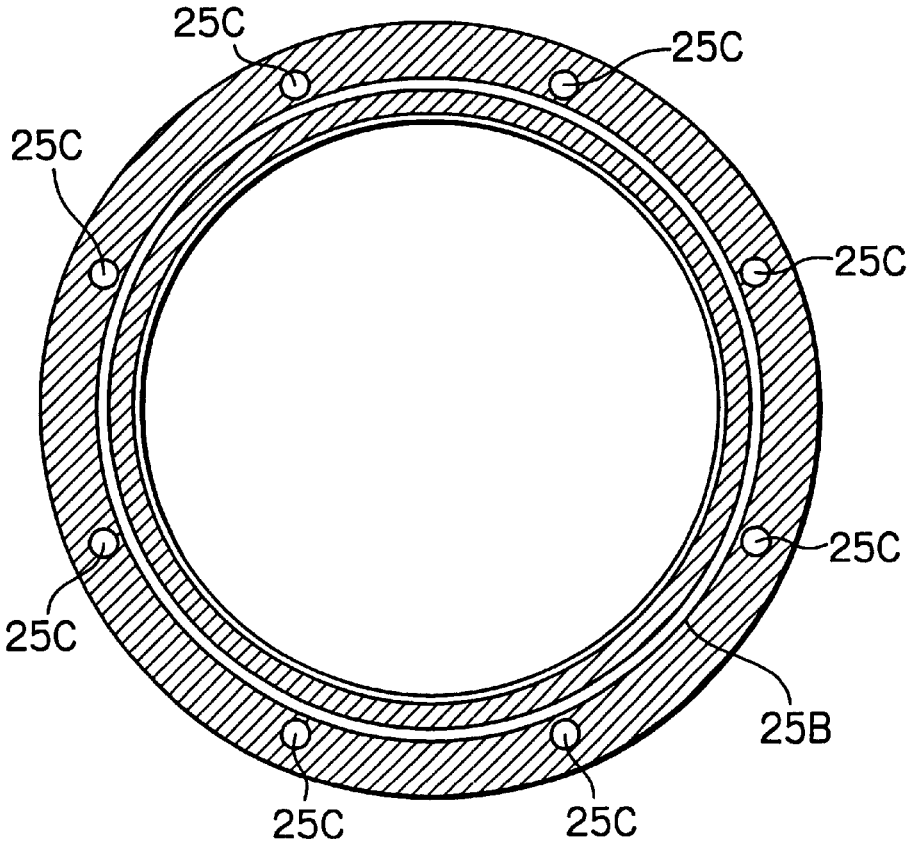

The bottom cylinder sealing ring 25 has, as shown in an enlarged drawing of FIG. 13(A), annular grooves 25A, 25B for O-ring, each being formed on an inner surface and on a top surface thereof respectively, and a lower side of the lower pressure chamber 27' is sealed by O-rings fitted in respective annular grooves 25A, 25B.

An inlet/outlet port 28 for compressed air is formed on a side wall of the bottom cylinder sealing ring so as to communicate with the lower pressure chamber 27'. A compressed air supply tube 29A is connected to the inlet/outlet port 28 as shown in FIG. 2, and the compressed air supply tube 29A is also connected through a four way valve 30 and a connector 31 to a compressor though not shown.

Figure 14:
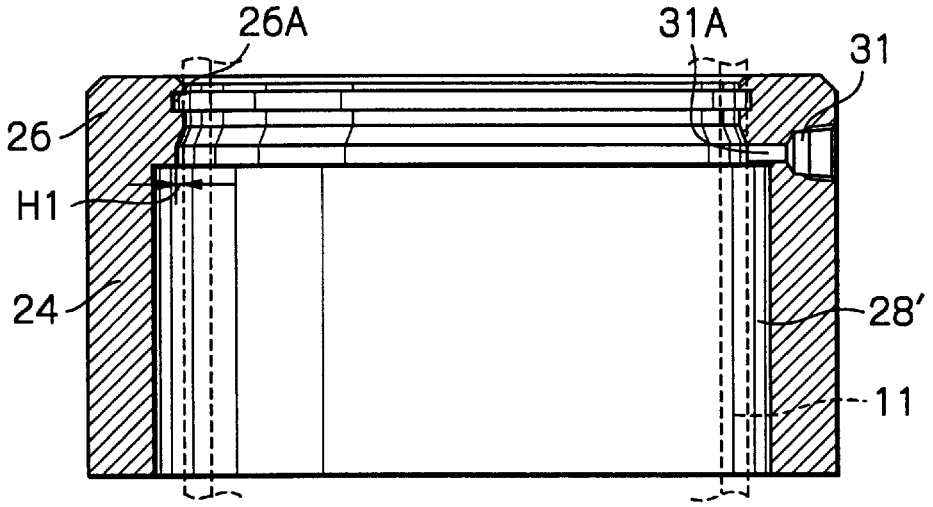
FIG. 14 is an enlarged view of a cylinder shown in FIG. 3, wherein (A) is a longitudinal sectional view and (B) is a plan view.
Figure 14:
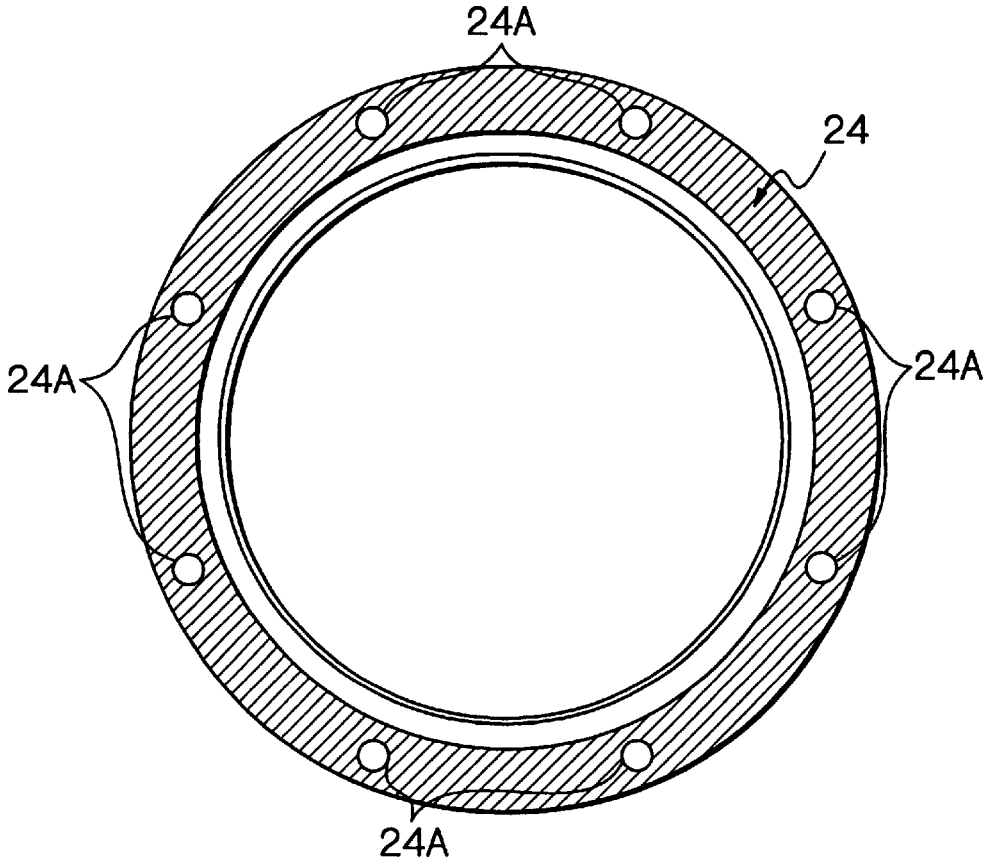

A plurality of threaded holes 24A is formed on an under surface of the cylinder 24 along a pitch circle placing a specified distance between holes as shown in an enlarged drawing of FIG. 14(B) in a pattern that the position thereof corresponds to that of the through holes 17A of the upper plate 17, and also a plurality of through holes 25C for screw is formed on the bottom cylinder sealing ring 25 along a pitch circle placing a specified distance between holes as shown in FIG. 13(B) in a pattern that the position thereof corresponds to that of the threaded holes 24A so that the bottom cylinder sealing ring 25 is vertically clamped by and fixed between the cylinder 24 and the upper plate 17.

As shown in an enlarged drawing of FIG. 14(A), an annular groove 26A for O-ring is formed on an inner surface of the top cylinder sealing ring 26 and an upper side of the upper pressure chamber 28' is sealed by an O-ring fitted in the annular groove 26A. An inlet/outlet port 31 for compressed air is formed on the top cylinder sealing ring 26 so as to communicate with the upper pressure chamber 28', and a compressed air supply tube 29 is connected to the inlet/outlet port 31 for compressed air as shown in FIG. 2, so that the compressed air may flow in or out of the upper pressure chamber 28' through the compressed air supply tube 29.

A clearance H1 is provided between an opening 28A, 31A of the inlet/outlet port 28, 31 for compressed air and an outer surface of the liner cylinder 11, so that the compressed air can easily flow into or out of the lower pressure chamber 27' and the upper pressure chamber 28' through the clearance H1.

According to the pressure pump described above, as shown in FIG. 3 by a solid line, the transport pipe 4 is moved downward and thereby the follow plate unit 5 is moved downward when the high viscosity fluid stored in the can 32A is to be pumped by pressure. At the same time, the compressed air is supplied to the lower pressure chamber 27' and thereby the upper plate 17 is moved downward to extend the outer diameter of the ring type elastic sealing member 18 and to bring an outer end face of the contact portion 18C into contact with a wall inner surface 32C of the can 32A.

At that time, a pressure is applied to the high viscosity fluid 32B in the can 32A by the lower plate 16, and consequently the high viscosity fluid 32B is pumped out through the guide passage 7 for the high viscosity fluid and the transport pipe 4, and is discharged outward through a discharge port 32D (see FIG. 1).

When the follow plate unit 5 reaches down to a bottom 32E of the can 32A and almost all of the high viscosity fluid 32B has been discharged, the follow plate unit 5 is moved upward by moving the transport pipe 4 upward. At the same time, the compressed air is supplied to the upper pressure chamber 28' to expand a volume of the upper pressure chamber 28' and to reduce that of the lower pressure chamber 27', and thereby the upper plate 17 is moved upward together with the cylinder 24. Along with the upper plate 17 is moved upward the upper ring type elastic sealing member 18A which is fixed to the upper plate 17. This causes an inner periphery of the upper ring type elastic sealing member 18A located inner side of the outer periphery thereof and an inner periphery of the lower ring type elastic sealing member 18B located inner side of the outer periphery thereof to be deformed and separated from other, and, by the deformations of the upper ring type elastic sealing member 18A and the lower ring type elastic sealing member 18B, the outer diameter of the ring type elastic sealing member 18 is contracted to disengage the outer end face of the contact portion 18C from the wall inner surface 32C of the can 32A, which allows the follow plate unit 5 to be easily retracted from the can 32.

(Effect of the Invention)

Since the present invention is configured as described above, the follow plate unit can be smoothly retracted from the can without deteriorating a sealing capacity for drawing the high viscosity fluid out of the can and also an assembling operation thereof can be performed easily.

What is claimed is:

1. A pressure pump for high viscosity fluid in which, in order to draw and deliver by pressure a high viscosity fluid stored in a can therefrom, a follow plate unit for sealing an upper surface of said can to apply pressure to said high viscosity fluid stored therein is attached to a lower end of a transport pipe capable of being moved up-and-down with respect to said can, said pressure pump characterized in that said follow plate unit comprises: a follow plate body having a guide passage for the high viscosity fluid; a cylinder fitted on an outer surface of said follow plate body so as to be capable of being moved upward and downward along a vertical direction; an upper plate attached to said cylinder so as to be capable of being moved upward and downward along therewith; a lower plate attached to a lower portion of said follow plate body; and a ring elastic sealing member interposed between said upper plate and said lower plate; wherein a pressure chamber for making a compressed air flow in-and-out is provided between said follow plate body and said cylinder; a compressed air inlet/outlet port is provided on said cylinder so as to communicate with said pressure chamber; said ring elastic sealing member comprises an upper ring elastic sealing member and a lower ring type elastic sealing member; said lower ring type elastic sealing member is fixed to said lower plate; said upper ring elastic sealing member is fixed to said upper plate; said upper ring elastic sealing member and said lower ring type elastic sealing member are bonded with each other at outer peripheral portions thereof to be formed into a contact portion which is to be brought into contact with a wall inner surface of said can; and an outer diameter of said ring elastic sealing member is extended or contracted by flow-in or flow-out of the compressed air to or from said pressure chambers.

2. A pressure pump for high viscosity fluid in accordance with claim 1, in which a liner cylinder for guiding said cylinder along a vertical direction is inserted between said follow plate body and said cylinder, and an annular flange for partitioning said pressure chamber into an upper pressure chamber and a lower pressure chamber is formed on an outer surface of said liner cylinder.

3. A pressure pump for high viscosity fluid in accordance with claim 2, in which said cylinder has a bottom cylinder sealing ring and a top cylinder sealing ring, an annular groove for receiving O-ring is formed on an inner surface of each of said bottom and said top cylinder sealing rings, an O-ring is fitted into each of said annular grooves for receiving O-ring in order to seal said compressed air within said pressure chamber, and another annular groove for receiving O-ring is formed on said annular flange, into which an O-ring is fitted for preventing a leakage of said compressed air from said upper pressure chamber to said lower pressure chamber.

* * * * *